United States Patent [19]

Mascher

[11] 4,365,128

[45] Dec. 21, 1982

[54] HIGH-VOLTAGE CIRCUIT BREAKER

[75] Inventor: Karl Mascher, Berlin, Fed. Rep. of Germany

[73] Assignee: Siemens Aktiengesellschaft, Munich, Fed. Rep. of Germany

[21] Appl. No.: 212,218

[22] Filed: Dec. 2, 1980

[30] Foreign Application Priority Data

Dec. 7, 1979 [DE] Fed. Rep. of Germany ..... 2949753

[51] Int. Cl.[3] ..... H01H 33/28

[52] U.S. Cl. ..... 200/148 F; 200/148 R; 200/153 L; 200/153 LB; 200/148 D

[58] Field of Search ..... 200/148 R, 148 F, 148 H, 200/148 D, 153 L, 153 LB, 153 LA, 150 C

[56] References Cited

U.S. PATENT DOCUMENTS 3,187,143 6/1965 Kropp ..... 200/153 LB
3,763,340 10/1973 Noack ..... 200/148 D
4,016,385 4/1977 Golioto ..... 200/153 L

FOREIGN PATENT DOCUMENTS 2108915 2/1971 Fed. Rep. of Germany .

OTHER PUBLICATIONS

"'2-Cycle' $SF_6$ Circuit Breaker 3AT5, 362–765kV, 40–80 kA," Published by Siemens Aktiengesellschaft, Nov. 1978, Order No. B122/1698-220.

*Primary Examiner*—Robert S. Macon
*Attorney, Agent, or Firm*—Kenyon & Kenyon

[57] ABSTRACT

To reduce overvoltages when switching high-voltage circuit breakers, particularly when connecting unloaded overhead lines, closing resistors are used which, during closing of the breaker, are connected in parallel relationship with the main switching gap of the circuit breaker by means of an auxiliary switching gap. After the main switching gap is closed, the closing resistor is disconnected by opening the auxiliary switching gap before the main gap opens and keeping the auxiliary gap open until the main switching gap is reclosed. For this purpose, the high-voltage circuit breaker includes a movable auxiliary contact pin which is spring loaded in the opening direction of the auxiliary switching gap, and a connecting rod which is linked to the auxiliary contact pin and is connected, hinged, to a rotatably supported crank drive of the drive unit of the breaker. The crank drive has a gate aperture which forcibly guides one end of the connecting rod and comprises a first curved portion which is concentric with a rotating shaft for the crank drive, and an adjoining straight portion which is disposed at the end of the curved portion located along the direction of rotation of the crank drive during closing of the breaker and is disposed approximately radially outwardly with respect to the crank drive shaft.

5 Claims, 6 Drawing Figures

HIGH-VOLTAGE CIRCUIT BREAKER

BACKGROUND OF THE INVENTION

1. Field of the Invention

The present invention relates to high-voltage circuit breakers, and in particular to high-voltage circuit breakers including a closing resistor which, during closing of the breaker, is connected in parallel relationship with the main switching gap of the breaker by means of an auxiliary switching gap which closes before the main switching gap, and is disconnected, after the auxiliary switching gap closes, by opening the auxiliary switching gap before the main switching gap opens until the main switching gap is again closed; a movable spring-loaded contact pin, biased in the opening direction of the auxiliary switching gap; and a connecting rod which is linked to the auxiliary contact pin and is connected, hinged, to a rotatably supported crank drive of the drive unit of the circuit breaker.

2. Description of the Prior Art

In high-voltage circuit breakers of the foregoing type, which are described, for example, in German Pat. No. 21 08 915 (which corresponds to U.S. Pat. No. 3,763,340), the crank drive moves a crankpin which moves the connecting rod by means of a stop cam until the latter strikes a stationary tripping device and releases the connecting rod to permit a return movement. After the release, the crankpin moves in an elongated aperture which is disposed in the connecting rod and the length of which is matched to the length of the return travel of the auxiliary contact pin.

Siemens Publication "2-cycle $SF_6$ Circuit Breaker 3AT5," Order No. B 122/1698-220, describes a high-voltage circuit breaker the crank of which consists of a drive lever connected to the connecting rod of the breaker, a spring-loaded dog member guided therein, and a drive disc connected to the drive shaft of the breaker, all of which are secured against mutual rotation. During closing of the breaker, the drive lever is rotated together with the drive disc due to the latched position of the dog member at the drive disc until a stationary stop disengages the dog member from the drive disc against the spring load, thus starting the return movement of the auxiliary contact pin, which is also spring-loaded.

SUMMARY OF THE INVENTION

It is an object of the present invention to provide an improved high-voltage circuit breaker in which the mechanical design of the auxiliary switching gap is simplified, and in particular, the need for stop cams, ratchet mechanisms or the like is eliminated.

This and other objects of the invention are achieved by a crank drive having a gate aperture which forcibly guides one end of the connecting rod of the breaker. The gate aperture comprises a first curved portion which is concentric with a rotating shaft on which the crank drive is mounted, and a second linear portion which is located at the end of the curved portion which is located along the direction of rotation of the crank drive during closing of the breaker. The linear portion of the gate aperture is also disposed approximately radially outwardly with respect to the rotating shaft of the crank drive.

Control of the movable contact pin of the auxiliary switching gap of the breaker is accomplished by the gate aperture, and the time sequence of the auxiliary switching gap contact pin movement results from the shape of the two parts of the gate aperture and their relative lengths. By spring loading the movable auxiliary switching gap contact pin, forcible guidance at only one guide surface of the gate aperture is obtained. In order to prevent undesirable free-running of the auxiliary contact pin in the event of shock pulses of the drive, the gate aperture preferably has parallel guide surfaces for guiding the crank bearing of the connecting rod. A form-locking connection between the connecting rod and the crank drive is thereby obtained. The effect of unavoidable shock forces acting through the connecting rod on the auxiliary switching gap can be reduced if the gate aperture has damping cushions provided at one end thereof.

The release of the connecting rod and initiation of its return motion during closing of the circuit breaker is achieved essentially automatically by the gate aperture. It may, nevertheless, be advantageous in some cases to provide on the crank drive adjacent the linear portion of the gate aperture a projection member which acts as a trigger on the connecting rod. A particularly advantageous embodiment of the invention is obtained if the crank drive is provided with a hub which forms a stop and guide surface for the connecting rod.

An embodiment of the invention will now be described, and its operation explained with reference to the drawings, in the following detailed description.

DETAILED DESCRIPTION

Figure 1:
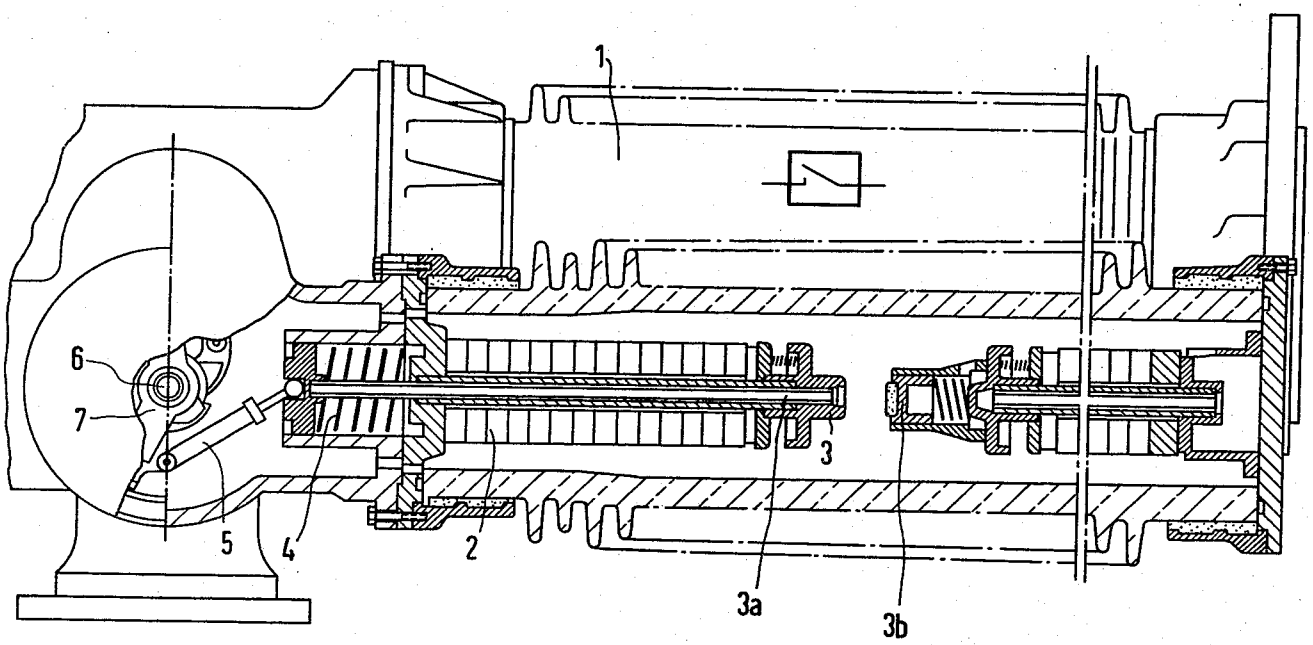
FIG. 1 is a schematic, partial, cross-sectional view of an improved high-voltage circuit breaker constructed according to the present invention.

Referring now to FIG. 1, there is shown a high-voltage circuit breaker including a main switching gap 1 which can be shunted to attenuate switching overvoltages by a closing resistor 2. For this purpose, an auxiliary switching gap 3, which consists of a movable contact pin 3*a* and a spring-loaded fixed contact 3*b*, is coupled to the closing resistor 2. The movable contact pin 3*a* is also spring-loaded by a spring 4 and is biased in the opening direction of the pin 3*a*. The pin 3*a* is actuated by means of a connecting rod 5 and a crank drive 7 mounted on a rotating shaft 6.

The motion cycle for movable contact pin 3*a* is controlled so that during closing of the breaker, auxiliary switching gap 3 is closed before main switching gap 1 closes. Closing of the main switching gap shorts out the series circuit consisting of closing resistor 2 and auxiliary switching gap 3 and thereby renders the circuit inoperative. In order to assure that the closing resistor does not remain under load during opening of the breaker, auxiliary switching gap 3 opens automatically after main switching gap 1 is closed before the main switching gap 1 opens. The auxiliary switching gap remains in this "off" position until the main switching gap 1 is reclosed.

The foregoing motion cycle is achieved by the crank drive in the manner illustrated in FIGS. 2 through 6. Starting at the "off" position of the circuit breaker, in which main switching gap 1 and auxiliary switching gap 3 are open, the shaft 6 is rotated during the closing operation of the breaker in the direction of arrow 8. The crank drive 7 is thereby also rotated in the same direction.

Figure 2:
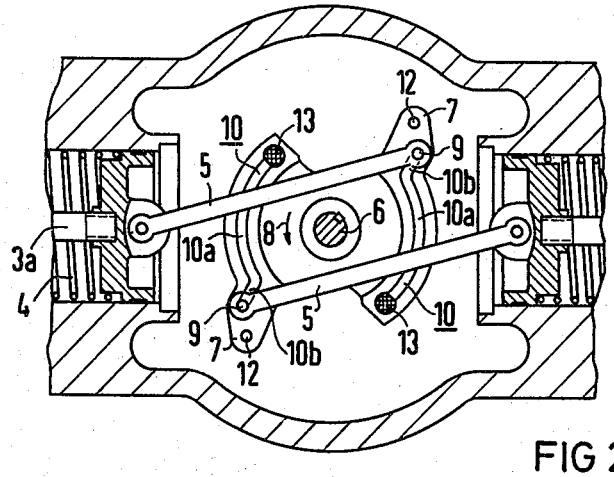
FIGS. 2 through 6 are schematic, partial cross-sectional views of the circuit breaker of FIG. 1 illustrating the various positions of the crank drive for the closing resistor during the closing and opening operations of the breaker.

The crank drive has a gate aperture 10 including parallel guide surfaces which surround a joint or connecting bearing 9 at one end of the connecting rod 5. The gate aperture 10 includes a first curved portion 10*a* which is concentric with rotating shaft 6 of the crank drive 7, and a second linear, i.e., straight portion 10*b* which is located ahead of, i.e., at the end of portion 10*a* located along the direction of rotation of crank drive 7 during closing of the breaker and is disposed approximately radially outwardly with respect to shaft 6. If the drive for auxiliary switching gap 3 is rotated in the direction of arrow 8 as shown in FIG. 2, then connecting bearing 9, which is disposed in linear portion 10*b* of gate aperture 10, and linear portion 10*b* of the gate aperture, are moved with the result that movable contact pin 3*a* is moved in the direction of arrow 11.

Figure 3:
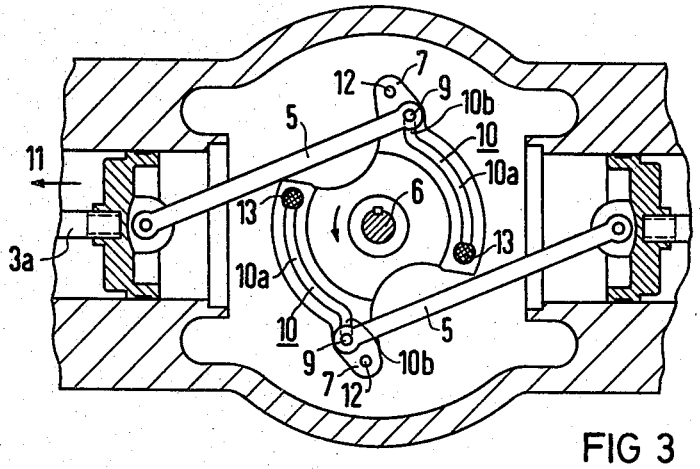
Figure 4:
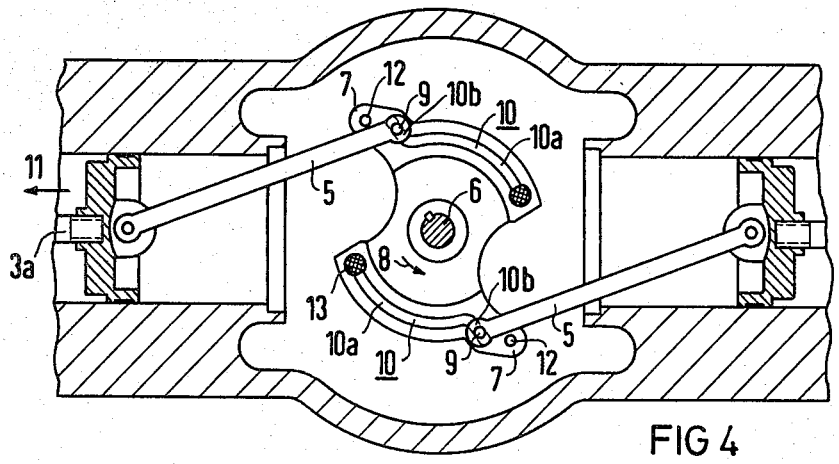

In the position of the crank drive illustrated in FIG. 3, movable contact pin 3*a* engages fixed contact 3*b*, i.e., the auxiliary switching gap 3 is closed. In the further course of the closing operation of the breaker, the crank drive 7 arrives at a release position in which the spring 4 of movable contact pin 3*a* acting opposite the direction of arrow 11 pushes connecting bearing 9 from linear portion 10*b* of gate aperture 10 into curved portion 10*a*, whereupon an abrupt release of the connecting rod occurs due to the bend between the two portions 10*a* and 10*b*. This abrupt release is aided by a projection member 12 disposed on the surface of the crank drive 7 which enages and acts as a trigger on the connecting rod 5, as shown in FIG. 4.

Figure 5:
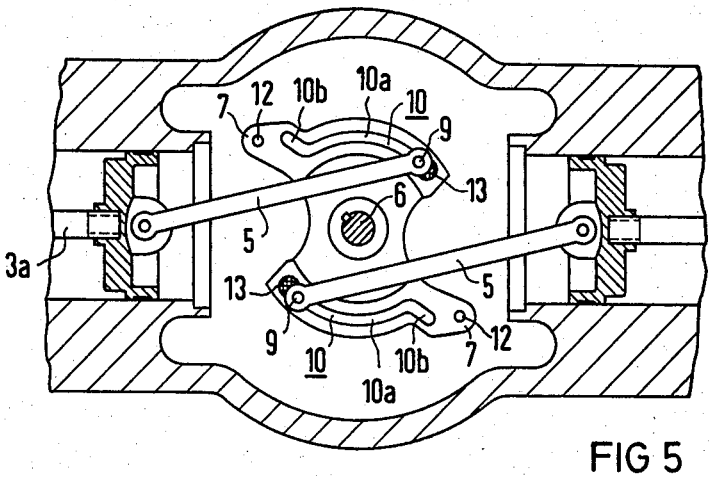
Figure 6:
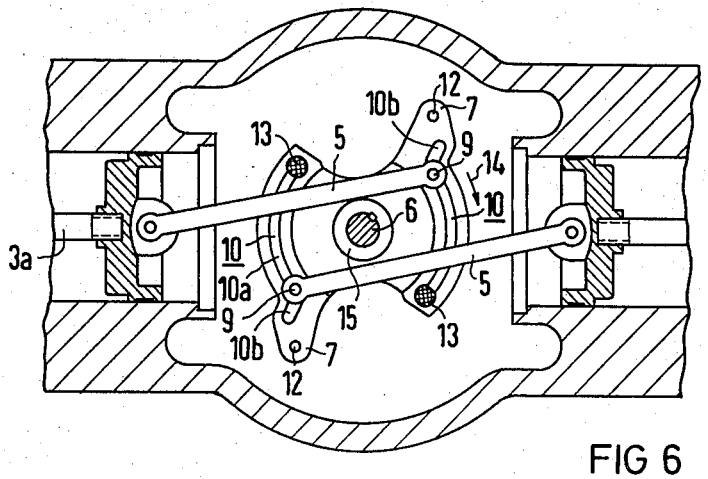

As illustrated in FIG. 5, the connecting rod bearing 9 traverses the curved portion 10*a* of gate aperture 10 to a damping cushion 13 provided at the end of curved portion 10*a* of the gate aperture opposite linear portion 10*b*. In the "off" position of auxiliary switching gap 3, which is shown in FIG. 6, the main switching gap 1 is closed. To open the main switching gap, crank drive 7 is moved, together with the mechanism provided for this purpose, in the direction of arrow 14. A hub 15 is provided on the crank drive and surrounds the rotating shaft 6, thereby forming a stop and guidance surface for the connecting rod 5. In the "off" position of main switching gap 1, connecting rod bearing 9 again moves into the linear portion 10*b* and is ready for reclosing. The damping cushion 13 may be fabricated of rubber or another suitable resilient shock-absorbing material.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a high-voltage circuit breaker including a closing resistor which, during a closing operation of the breaker, is connected in parallel relationship with a main switching gap of the breaker by means of an auxiliary switching gap which closes before said main switching gap closes, and which is disconnected after said auxiliary switching gap closes by opening said auxiliary switching gap before said main switching gap opens, said auxiliary gap being open until said main switching gap is closed again; a movable, spring-loaded contact pin biased in the opening direction of said auxiliary switching gap; and a connecting rod coupled at one end to said auxiliary contact pin and at the other end to a rotatable crank drive of a drive unit of the circuit breaker, said crank drive being mounted on a rotating shaft; the improvement comprising said crank drive including a gate aperture for forcibly guiding said other end of said connecting rod, said gate aperture comprising a first curved portion which is concentric with said rotating shaft on which said crank drive is mounted, and a linear portion disposed at one end of said curved portion located along the direction of rotation of said crank drive during said closing operation of said breaker, said linear portion being further disposed approximately radially outwardly with respect to said rotating shaft of said crank drive.

2. The improvement recited in claim 1, wherein said gate aperture includes parallel guide surfaces, said connecting rod including a crank bearing at said other end thereof which is guided by said parallel guide surfaces.

3. The improvement recited in claim 1, wherein said gate aperture includes damping cushions fabricated of resilient material disposed at the end of said curved portion opposite said linear portion of said gate aperture.

4. The improvement recited in claim 1, wherein said crank drive includes a projection member extending outwardly from the surface thereof adjacent said linear portion of said gate aperture for engaging said connecting rod and releasing said rod from said linear portion thereby opening said auxiliary switching gap of said circuit breaker.

5. The improvement recited in claim 1, wherein said crank drive includes a hub member disposed about said rotating shaft perpendicular to the surface thereof for forming a stop and guide surface for said connecting rod during opening of said circuit breaker.

* * * * *